US006186494B1

(12) United States Patent
Merkli

(10) Patent No.: US 6,186,494 B1
(45) Date of Patent: Feb. 13, 2001

(54) DEVICE FOR DEPOSITING PRINTED SHEETS ON A GUIDE

(75) Inventor: Peter Merkli, Oftringen (CH)

(73) Assignee: Grapha-Holding AG, Hergiswil (CH)

( * ) Notice: Under 35 U.S.C. 154(b), the term of this patent shall be extended for 0 days.

(21) Appl. No.: 09/068,926

(22) PCT Filed: Oct. 31, 1997

(86) PCT No.: PCT/CH97/00413

§ 371 Date: May 20, 1998

§ 102(e) Date: May 20, 1998

(87) PCT Pub. No.: WO98/19947

PCT Pub. Date: May 14, 1998

(30) Foreign Application Priority Data

Nov. 6, 1996 (CH) ..... 2740/96

(51) Int. Cl.[7] ..... B65H 29/06

(52) U.S. Cl. ..... 271/82; 271/314; 271/184; 270/52.26

(58) Field of Search ..... 270/52.14, 52.16, 270/52.25, 52.26, 52.27, 52.29; 271/82, 314, 315, 184

(56) References Cited

U.S. PATENT DOCUMENTS

| | | | | |
|---|---|---|---|---|
| 1,118,409 | * | 11/1914 | Gitzendanner | 270/54 X |
| 2,251,943 | * | 8/1941 | Kleineberg | 270/54 X |
| 4,260,145 | | 4/1981 | Mebus et al. . | |
| 4,299,378 | * | 11/1981 | Muller | 270/54 X |
| 4,350,327 | * | 9/1982 | Muller | 270/54 X |
| 4,491,311 | * | 1/1985 | Glanzmann | 270/54 X |

FOREIGN PATENT DOCUMENTS

| | | |
|---|---|---|
| 493337 | 8/1970 | (CH) . |
| 0708044 | 4/1996 | (EP) . |

* cited by examiner

*Primary Examiner*—Christopher P. Ellis
*Assistant Examiner*—Patrick Mackey
(74) *Attorney, Agent, or Firm*—Friedrich Kueffner

(57) ABSTRACT

A device for placing printed sheets on a guide includes a mechanism for accelerating a printed sheet in an off-transport direction to a transverse velocity before the printed sheet is placed on the guide. The mechanism includes a gripping device for grasping the printed sheet by the front end thereof as seen in the off-transport direction and for accelerating the printed sheet in the off-transport direction by pulling the printed sheet.

11 Claims, 1 Drawing Sheet

DEVICE FOR DEPOSITING PRINTED SHEETS ON A GUIDE

BACKGROUND OF THE INVENTION

1. Field of the Invention

The invention is directed to a device for placing printed sheets on a guide.

2. Description of the Related Art

A device of this type became known in the prior art through CH-A-493 337 by the present Applicant. In this device, folded printed sheets from a stack are opened from below by opening drums and are placed on a conveying chain. Before the printed sheets are transferred to the conveying chain, each of them is thrown against a sword or knife arranged over the conveying chain. The knife is moved back and forth between a rear end position and a front end position in the direction of the conveying chain, so that the printed sheets need not be accelerated abruptly to the required transporting velocity by the drivers of the conveying chain. The sheet to be placed is thrown against the knife in the rear end position and is knocked forward by it. The difficulty in this device consists in that the knife jerks about in the manner of a spring at high speeds so that the placed printed sheet is unstable and can fly away. This difficulty exists particularly in the case of light printed sheets and at high speeds.

SUMMARY OF THE INVENTION

The object of the invention is to provide a device of the type mentioned above which avoids the above-mentioned difficulty.

In accordance with the present invention, in a device for placing printed sheets on a guide using a mechanism which accelerates a printed sheet in an off-transport direction to a transverse velocity before it is placed on the guide, the object is met by providing the mechanism with gripping means which grasp the printed sheet by its front end as seen in the off-transport direction and accelerate the sheet in the off-transport direction by pulling the sheet.

In the device according to the invention, the printed sheets are grasped and accelerated accompanied by pulling. The printed sheets can accordingly be grasped before or immediately after they have been released by the opening drums and transported in a positive manner until delivered to the conveyor chain. Since the gripping means grasp the front end of the printed sheets, the printed sheets are engaged forward of their center of gravity, which stabilizes the printed sheets in the running direction.

A particularly reliably operating and economical construction of the device according to the invention can be realized in accordance with a further development of the invention in that the gripping means execute an orbiting or rotating movement. A guiding of the printed sheets that is particularly safe from disturbance is ensured when the printed sheets are decelerated sinusoidally in the depositing direction and are accelerated sinusoidally in the off-transport direction. In this way, higher speeds can be achieved even with printed sheets which are light and difficult to handle. The invention accordingly makes it possible for even light printed sheets to be transported at higher speeds compared with the prior art, while nevertheless ensuring the required reliability of operation. The device according to the invention is equally suitable for head-folded printed sheets and tabloids.

Further advantageous features are indicated in the dependent patent claims, the following description, and the drawing.

BRIEF DESCRIPTION OF THE DRAWING

An embodiment example of the device according to the invention will be explained more fully hereinafter with reference to the drawing.

DESCRIPTION OF THE PREFERRED EMBODIMENTS

Figure 1:
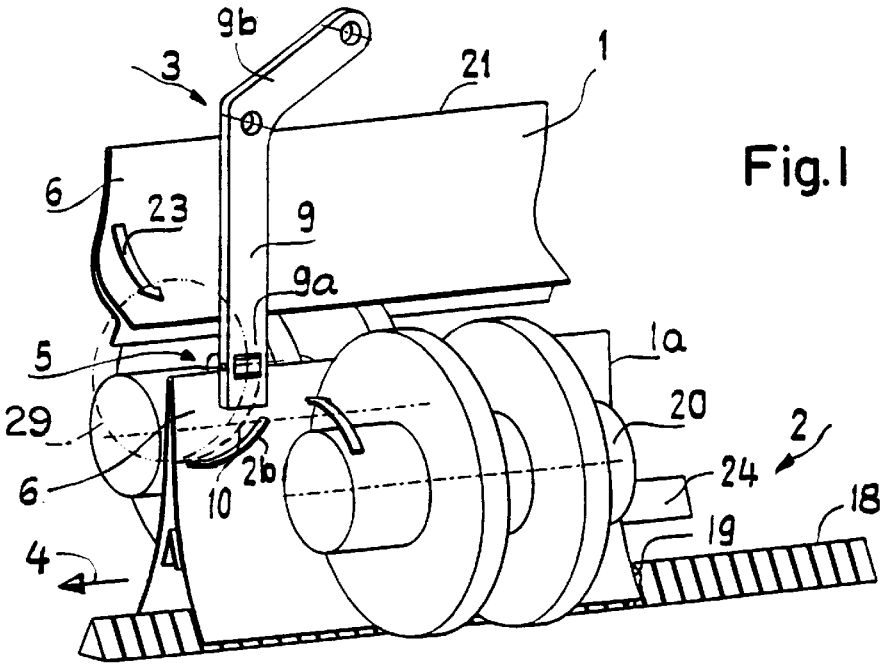
FIG. 1 is a schematic perspective view of a device according to the invention.

According to FIG. 1, the device has two oppositely located opening drums 20 of a feeder which, in a known manner, opens isolated printed sheets 1 so that they can be placed on a guide 2 so as to rest thereon in the manner of a saddle. The printed products 1 are taken from a stack, not shown, and fed to the opening drums 20 in the direction of arrow 23. In this case, the movement of the printed sheets 1 is substantially vertical, wherein a top fold 21 is oriented horizontally. However, constructions in which the printed products 1 are moved horizontally rather than vertically, for example, are also conceivable.

The guide 2 has a transporting chain 18, known per se, at which drivers 19 are arranged in defined equidistant intervals. The transporting chain 18 is preferably a link chain and is moved in the direction of arrow 4 for transporting the printed products 1. A knife 24 which can be stationary with respect to the frame or movable is arranged vertically over the transporting chain 18. This knife 24 guides the printed product 1 in the direction of arrow 4. However, a knife 24 of this kind is not obligatory.

A mechanism 3 which has an arm 9 projecting centrally between the opening drums 20 is mounted between the opening drums 20 at a frame, not shown. This arm 9 extends downward, as can be seen, and has, at a bottom end 9*a*, gripping means 5 which are shown more fully in FIGS. 2 and 3.

The arm 9 is connected at a top end 9*b* by screws 29 (FIG. 2) to driving means 25 which move the arm 9 in coordination with the machine cycle in such a way that the gripping means 5 execute a circular movement indicated by the dash-dot line 29. The movement direction in FIG. 1 is indicated by the arrow 26 and is accordingly effected in the clockwise direction with reference to this view. Suitable driving means for carrying out a rotating movement of this kind are known, per se, to the person skilled in the art and are therefore not described more fully.

Figure 2:
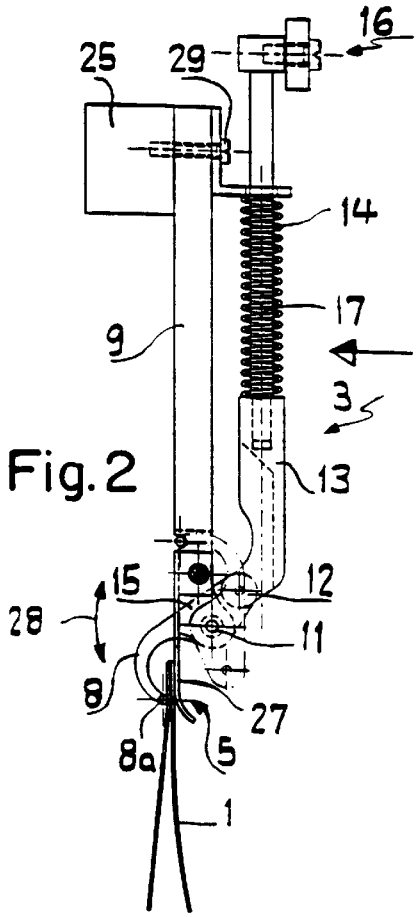
FIG. 2 is a plan view of the gripping means.
Figure 3:
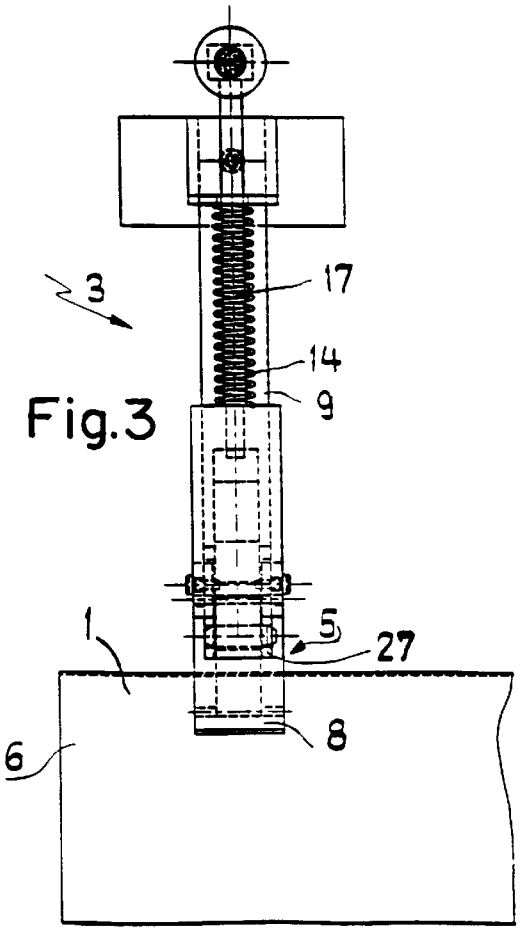
FIG. 3 is a plan view of the gripping means in the direction of arrow III in FIG. 2.

As is shown by FIGS. 2 and 3, the gripping means 5 have a strip-shaped retaining part 27 which is arranged so as to be fixed to the arm 9 at the bottom and which cooperates with a movable clamping part 8. The clamping part 8 is mounted on the retaining part 27 by a pivot joint 11 so as to be pivotable to a limited extent in the direction of the double arrow 28 and is connected with an actuating member 13 by means of an additional joint 12. This vertically extending actuating member 13 is connected by a rod 17 to driving means 16 at which a tension spring 14 is arranged. When the actuating member 13 is moved downward counter to the tension direction of the spring 14, the clamping part 8 is pivoted into the position shown by a dashed line. This movement is likewise carried out within the machine cycle and can be controlled, for example, by a cam, not shown. In the position of the clamping part 8 indicated by the solid line, a front end 8*a* of the clamping part 8 is pressed against the retaining part 27 by the tensile force of the spring 14. The manner of operation of the device according to the invention will be described in the following.

In the position of the gripping means 5 shown in FIG. 1, these gripping means 5 are located approximately at the 3-o'clock position on the circular path indicated by the dashed line 20. In this position, a printed sheet 1*a* to be placed on the transporting chain 18 is grasped at its front end 6 by the gripping means 5 and clamped on the arm 9. The printed sheet la remains fixed at the arm 9 until the gripping means 5 reach the six-o'clock position. In so doing, the gripping means 5 describe a quarter arc 10 shown by a dashed line. During this movement, the printed sheet 1*a* is decelerated sinusoidally in the depositing direction and is accelerated sinusoidally in the off-transport direction according to arrow 4. Thus, in this case, the deflection of approximately 900° C. is carried out. The printed sheet 1*a* is guided at the arm 9 and is smoothly transferred to the transporting chain 18 by positive transport. When the gripping means 5 have reached the six-o'clock position, the actuating member 13 is moved downward by the driving means 16 so that the printed sheet 1*a* is released. The printed sheet 1*a* which is accelerated in the direction of arrow 4 now lies on the knife 24 in the manner of a saddle and is grasped by the driver 19. The driver 19 pushes the accelerated printed sheet 1*a* away from the knife 24 in the direction of the arrow 4, whereupon the printed sheet 1*a* drops onto the transporting chain 18.

Between the six-o'clock position and the three-o'clock position, the clamping part 8 is in the position shown by dashed lines in FIG. 2. The clamp is accordingly open in this case. Shortly before reaching the three-o'clock position, the printed sheet 1*a* is deposited on the transporting chain and another printed sheet 1 is now located in its position shown in FIG. 1. This printed sheet 1 is now grasped from the top at the front end 6 in the region of the fold 21, as was described above, and is placed on the transporting chain 18 in the same way during the subsequent movement as was described above. The circular movement of the gripping means 5 is preferably circular and, of course, is adapted to the transporting speed of the transporting chain 18. The printed products 1 are grasped in the above-described three-o'clock position before or immediately after they are released by the opening drums 20. It is essential that the printed products 1 are grasped before their center of gravity as viewed in the direction of arrow 4 and are pulled for their acceleration. As was explained above, the printed products 1 are fixed at the arm 9 during their acceleration and are accordingly guided in a controlled manner. The speed of the printed products in the direction of arrow 4 is highest when the gripping means have reached the six-o'clock position. Immediately before or after reaching the six-o'clock position, the printed products 1 are respectively grasped in a pushing manner by a driver 19 and are knocked away from the knife 24.

What is claimed is:

1. A device for placing printed sheets on a guide, the device comprising a mechanism for accelerating a printed sheet in an off-transport direction to a transverse velocity before the printed sheet is placed on the guide, the mechanism comprising gripping means for grasping the printed sheet by a front end thereof in the off-transport direction and for accelerating the printed sheet in the off-transport direction by pulling the printed sheet.

2. The device according to claim 1, wherein the gripping means are configured to grasp the printed sheet in an area of an upper fold of the printed sheet.

3. The device according to claim 1, wherein the gripping means are configured to decelerate the printed sheet grasped by the gripping means when the printed sheet is placed on the guide and for simultaneously accelerating the printed sheet in the off-transport direction.

4. The device according to claim 1, wherein the gripping means are configured to carry out a rotating movement.

5. The device according to claim 4, wherein the gripping means are configured to carry out a rotating movement in a plane extending parallel to the off-transport direction.

6. The device according to claim 4, wherein the gripping means comprise a clamping part movably attached to a rotating arm.

7. The device according to claim 4, wherein the gripping means are configured to grasp the printed sheet during the rotating movement approximately in the area of a quarter arc of the rotating movement.

8. The device according to claim 1, wherein the gripping means are configured to decelerate the printed sheet sinusoidally with respect to a placement velocity of the printed sheet and for accelerating the printed sheet sinusoidally in the off-transport direction.

9. The device according to claim 1, wherein the mechanism is configured to transport the printed sheet substantially horizontally in the off-transport direction.

10. The device according to claim 1, wherein the device is mounted at a feeder.

11. The device according to claim 10, wherein the feeder is a saddle stitching machine.

* * * * *